United States Patent [19]

Guridi

[11] Patent Number: 4,772,011

[45] Date of Patent: Sep. 20, 1988

[54] EXERCISE APPARATUS

[76] Inventor: Jose J. S. Guridi, 2000 Bering Dr., Suite 805, Houston, Tex. 77057

[21] Appl. No.: 77,400

[22] Filed: Jul. 24, 1987

[51] Int. Cl.[4] ..... A63B 1/02

[52] U.S. Cl. ..... 272/62; 272/900; 272/112

[58] Field of Search ..... 272/61, 62, 63, 112, 272/102, 111, 126, 113; 182/91, 92, 220, 228, 225, 215; 403/4, 383

[56] References Cited

U.S. PATENT DOCUMENTS

| | | | |
|---|---|---|---|
| 481,807 | 8/1892 | Neily | 272/62 |
| 829,653 | 8/1906 | Kercher | 272/62 |
| 1,035,904 | 8/1912 | Reach | 272/62 |
| 1,757,825 | 5/1930 | Albach | 272/62 |
| 3,282,604 | 11/1966 | Goldberg | 272/62 |
| 3,342,484 | 9/1967 | Christensen | 272/62 |
| 4,272,070 | 6/1981 | Schachner et al. | 272/62 |
| 4,657,242 | 4/1987 | Guridi | 272/62 |

FOREIGN PATENT DOCUMENTS

| | | | |
|---|---|---|---|
| 36610 | 4/1911 | Sweden | 272/62 |

*Primary Examiner*—Richard J. Apley
*Assistant Examiner*—Howard Flaxman
*Attorney, Agent, or Firm*—Guy E. Matthews

[57] ABSTRACT

A demountable exercise apparatus for installation in conventional doorways comprises a pair of parallel rectangular support members each formed of separable sections. Each support member has a plurality of longitudinally spaced polygonal recesses, in opposed relation, which receive the rectangular extensible ends of a horizontal exercise cross bar. The recesses are also adapted to receive the ends of an expandable chinning bar. The cross bar height is vertically adjustable by positioning in selected octagonal recesses in the support members. The angular position of the flat surfaces of the rectangular cross bar about its longitudinal axis may be adjusted by positioning the extensible rectangular ends between opposed flats of the polygonal recess. The chinning bar may be used in conjunction with the vertically adjustable cross bar for performing a more diverse program of exercise, and the cross bar allows use of auxiliary equipment such as an inclined board, a weight beach, ropes and pulley, or several others.

15 Claims, 3 Drawing Sheets

EXERCISE APPARATUS

BACKGROUND OF THE INVENTION

1. Field of the Invention

This invention relates to exercise apparatus, and more particularly to a demountable exercise apparatus for simple and easy installation in a door frame.

2. Brief Description of the Prior Art

Pierro, U.S. Pat. No. 802,312 discloses an adjustable horizontal bar which is suspended from the lintel of a door frame by a pair of clamping members. Clamps at each end of the bar secure the bar to the door jamb. Turnbuckles carried by suspending rods provide limited vertical adjustment.

Kercher, U.S. Pat. No. 829,653 discloses an exercise bar suspended between a pair of plates or brackets attached to the door jamb by wood screws or bolts. One of the plates is provided with a series of holes and the other plate is provided with a series of slots to accept the bar. The bar is secured in position by a spring loaded sliding plate member on the slotted plate.

Bardwell and Fuller, U.S. Pat. No. 1,266,155 discloses an exercise apparatus bar comprising a pair of channel brackets attachable to a door jamb by wood screws and having a series of aligned holes in the flange portions. A bar member having an eye at each end is bolted horizontally in the brackets, and may loosened at one end to pivot vertically downward when not in use.

Johnson, U.S. Pat. No. 1,493,548 discloses an exercise apparatus comprising a pair of U-shaped upright members mountable on door jambs by an upper and lower set of clamps. One upright is provided with a series of circular holes and the other is provided with a series of square holes. A horizontal bar having one round end and one square end is received in the appropriate holes of the uprights and secured against rotational movement by the square end. A tapered locking pin placed through the protruding square end of the bar prevents it from moving end wise Warman, U.S. Pat. No. 3,218,068 discloses an exercising bar comprising a pair of upright channel members on side rails and a horizontal tubular member having telescoping support brackets at each end. The tubular member is provided with slots at each end to slidably receive one end of the support brackets to accommodate various door widths and prevent the tubular member from turning. The other end of the support brackets are provided with a pair of hooks which are received in slots in the web portions of the side rail channels similar to conventional adjustable shelving systems. The channels are secured to the door jamb by wood screws or the like.

Christensen, U.S. Pat. No. 3,342,484 discloses an adjustable and lockable gymnasium apparatus comprising a pair of channel members mountable on a door jamb by wood screws or the like. The channel members are provided with a series of apertures each defined by an elongated slot having a central circular configuration. A round chinning bar is provided with elongated circular cavities at each end to slidably receive a shaft member. The shaft members are provided at their extended ends with a pair of notches and transverse pins which cooperatively engage the slotted apertures of the channel members.

Guridi U.S. Pat. No. 4,657,242 discloses a demountable exercise apparatus for installation in a conventional doorway. The support members fit vertically along each side of a door frame and have slots which receive the ends of horizontal support members which are constructed to pivot in place about their longitudinal axis.

The prior art in general, and none of these patents in particular, disclose a demountable exercise apparatus having the versatility and simplicity and universal applicability of the present invention.

SUMMARY OF THE INVENTION

One of the objects of this invention is to provide an exercise apparatus which may be installed in, and removed from conventional doorways easily and quickly.

Another object of this invention is to provide an exercise apparatus which when installed in conventional doorways will not interfere with the normal operation of the door or damage the doorway surface.

Another object of this invention is to provide an exercise apparatus having a vertically adjustable horizontal cross bar which may be used in conjunction with a chinning bar and other auxiliary equipment to provide the user with a diverse comprehensive exercise program.

Another object of this invention is to provide an exercise apparatus which will allow the user to perform isometric, calisthenic, and isotonic exercises.

Another object of this invention is to provide an exercise apparatus having a novel horizontal cross bar construction for improved support, comfort, and safety of the user.

Another object of this invention is to provide an exercise apparatus having a novel expandable horizontal chinning bar construction for improved support, comfort, and safety of the user.

Another object of this invention is to provide an exercise apparatus which is aesthetically pleasing, and economical to manufacture.

Another object of this invention is to provide an exercise apparatus which when disassembled forms a compact package for convenient shipping and storage.

Another object of this invention is to provide an exercise apparatus having a horizontal cross bar which may be positioned about its longitudinal axis to conform to the body pressed against it during exercise.

Other objects of the invention will become apparent from time to time throughout the specification and claims as hereinafter related.

The above noted objects and other objects of the invention are accomplished by a demountable exercise apparatus for installation in conventional doorways which comprises a pair of parallel rectangular support members each formed of separable sections. Each support member has a plurality of longitudinally spaced polygonal, preferably octagonal, recesses, in opposed relation, which receive the rectangular extensible ends of a horizontal exercise cross bar. The recesses are also adapted to receive the ends of an expandable chinning bar. The cross bar height is vertically adjustable by positioning in selected recesses in the support members. The angular position of the flat surfaces of the rectangular cross bar about its longitudinal axis may be adjusted by positioning the extensible rectangular ends between opposed flats of the octagonal recess. The chinning bar may be used in conjunction with the vertically adjustable cross bar for performing a more diverse program of exercise, and the cross bar allows use of auxiliary equipment such as an inclined board, a weight bench, ropes and pulley, or several others.

DESCRIPTION OF THE PREFERRED EMBODIMENT

Figure 2:
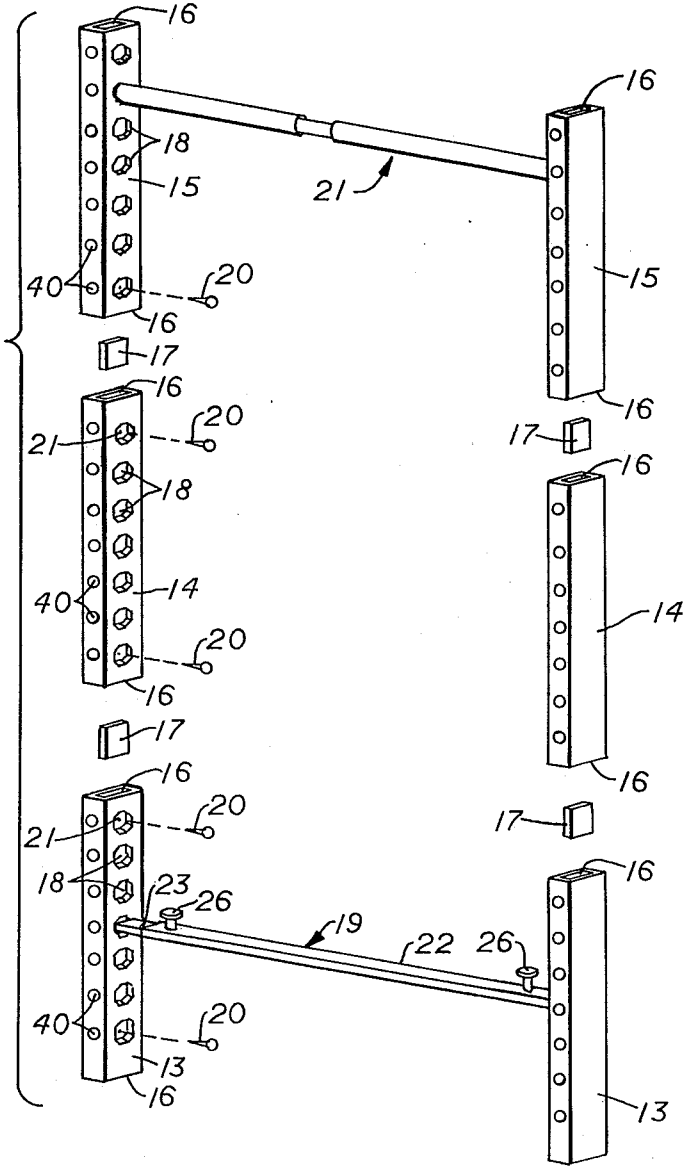
FIG. 2 is an exploded isometric view of the embodiment of the exercise apparatus shown in FIG. 1.
Figure 1:
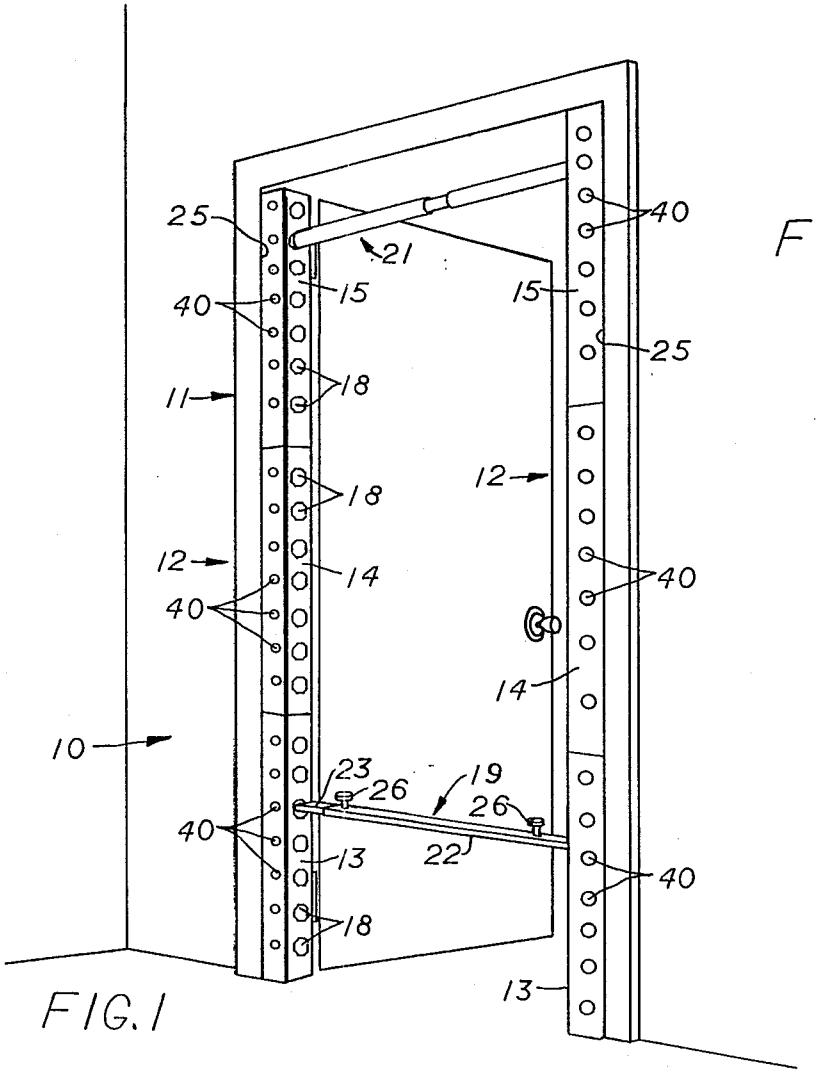
FIG. 1 is an isometric view of the exercise apparatus in accordance with the present invention installed in a conventional doorway.

Referring to the drawings by numerals of reference, there is shown, in FIG. 1, a preferred embodiment of an exercise apparatus 10 installed in a conventional doorway 11. Referring additionally to FIGS. 2 through 10, apparatus 10 comprises a pair of parallel rectangular support members 12 each composed of a lower section 13, an intermediate section 14, and an upper section 15. Each of the sections 13, 14, and 15 are identical in construction and each has a rectangular recess 16 in the top and bottom ends. The sections are preferably molded of high impact plastic material. A rectangular plug connector 17 is received in the rectangular recess 16 at each end of the intermediate sections to releasably join the top and bottom sections thereto.

The lower, intermediate, and upper sections 13, 14 and 15 each have a plurality of longitudinally spaced octagonal recesses 18 of sufficient size to receive the extensible rectangular ends of a rectangular cross bar 19. The octagonal recesses are of sufficient width across the flats to also receive the cylindrical ends of a chinning bar 21 which may be used in conjunction with the present invention.

The upper and lower sections 13 and 14 when fastened together are positioned against the door jambs 25 with the octagonal recesses 18 of the opposing sections in horizontal alignment and the bottom of the lower sections 13 resting securely on the floor. Wood screws 20 are inserted through holes 21 in the bottom of certain ones of the rectangular recesses 18 of the support members to secure the support members to the door jamb.

The rectangular cross bar 19 comprises a section of hollow rectangular tubing 22 having a length less than the width of the doorway 11 with the support members 13, 14, and 15 in place. The cross bar 19 is preferably formed of high impact plastic material with the sharp corners rounded to provide a comfortable gripping surface. Two extendable end members 23 of solid rectangular bar are slidably received within the open ends of the rectangular tubular member 22.

A pair of longitudinal slots 24 are disposed near the open ends of the rectangular tubular member 22. A threaded hole 25 is provided in each end member 23 in axial alignment with the longitudinal axis of the slot 24 and receives the threaded shaft of an adjustment knob 26. The knob 26 has a shoulder 27 which is larger in diameter than the width of the slot 24 allowing it to be tightened against the outer surface of the tubular member 22 to secure the end members 23 in a selective extended position.

Figures 3, 4, 5, 6, 7, 8, 9, 10, 11:
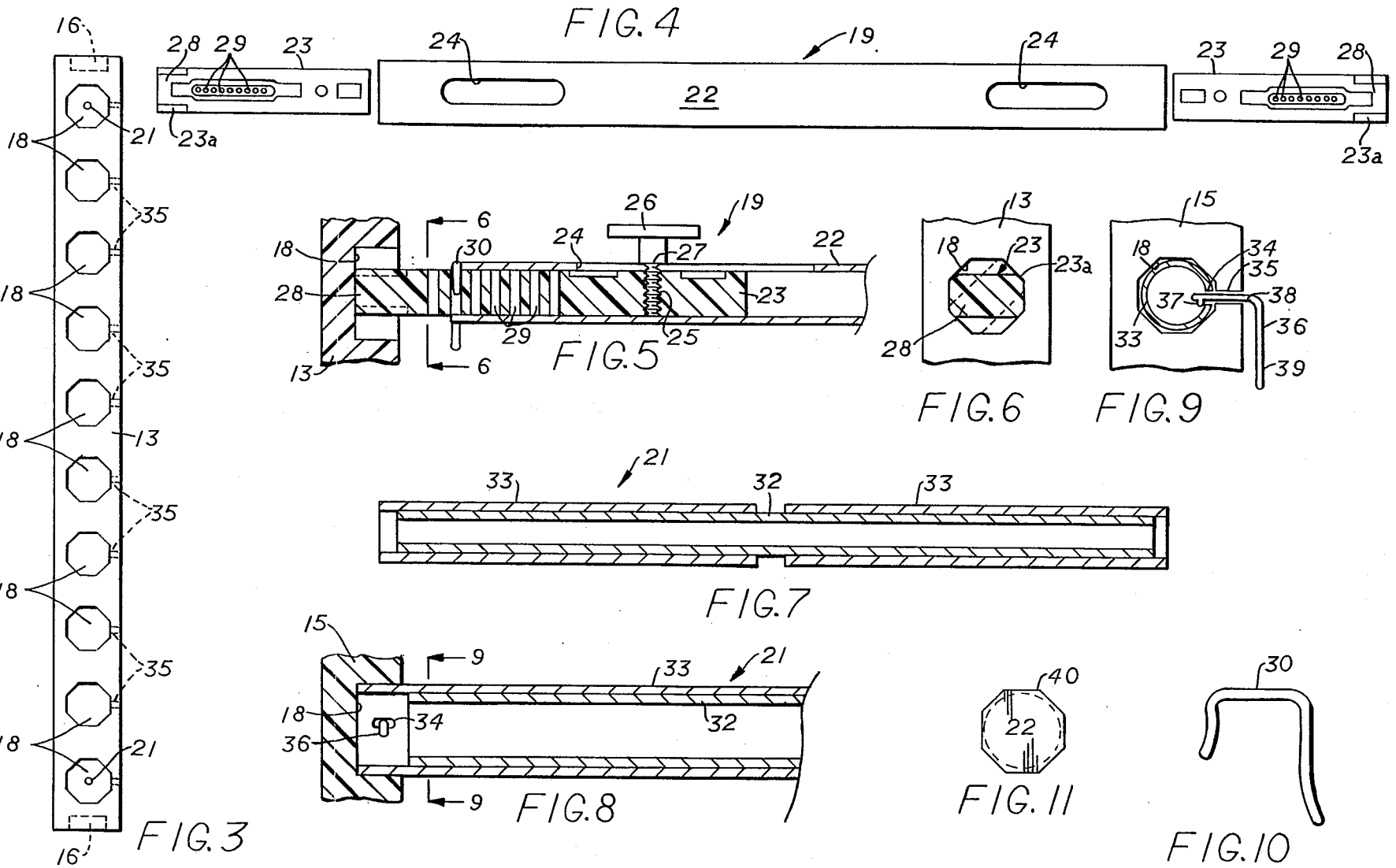
FIG. 3 is an elevational view of a support member section showing the octagonal recesses.
FIG. 4 is a top plan view of an extensible cross bar of the exercise apparatus with the end members disassembled.
FIG. 5 is a longitudinal cross section view in larger scale through one end of the extensible cross bar of FIG. 4 with the end member installed and positioned into the recess of the support member.
FIG. 6 is a transverse cross section through one cross bar end member illustrating the installation within the recess.
FIG. 7 is a longitudinal cross section view of the extensible chinning bar of the exercise apparatus.
FIG. 8 is a longitudinal cross section view in larger scale of the extensible chinning bar with the sleeve members extended and positioned into the recesses of the support member.
FIG. 9 is a transverse cross section through one of the chinning bar sleeve members illustrating the installation within the recess.
FIG. 10 is an elevation view of a lock pin for use in the exercise apparatus.
FIG. 11 is an elevation view of a label for use in the exercise apparatus.

Each end member 23 has a rectangular end 28 formed thereon of sufficient size to fit within the opposing flats of octagonal recesses 18 (FIG. 6). The outer end of end member 23 has beveled edges 23*a* which fit the walls of octagonal recess 18. Alternatively, the thickness of each end member 23 could be made substantially equal to the width of each face of octagonal recess 18. A plurality of longitudinally spaced parallel holes 29 extend transversely through the end members 23 near the rectangular end 28. When the end members 23 are in the correct extended position, a lock pin 30 (FIG. 10) is inserted through the hole 29 nearest the end of the tubular member 22 to prevent relative movement between the tubular member and the end members.

The cross bar 19 is positioned between the appropriate recesses 18, the end members 28 are extended outward into the recesses 18, the knobs 26 are tightened, and the lock pin 30 is inserted through the appropriate hole 29 in the end members 28. In this manner, the cross bar 19 is safely secured into the recesses 18, and the exercises may begin.

The angular position of the flat surfaces of the rectangular cross bar 19 about its longitudinal axis may be adjusted by positioning the extensible rectangular ends 28 between opposed flats of the octagonal recess 18. The close fit of the end of end member 23 in octagonal recess 18 prevents rotation of the cross bar 19 and also allows positioning of the cross bar to conform to the various parts of the body pressed against it during exercise and to provide a comfortable gripping surface. The cross bar height is vertically adjustable by positioning in selected recesses in the support members.

The octagonal recesses 18 are also of sufficient size to receive the cylindrical ends of an expandable chinning bar 21. The chinning bar 21 may be used in conjunction with the vertically adjustable cross bar 19 for performing a more diverse program of exercise.

The chinning bar 21 comprises a section of hollow tubing 32 having a length less than the width of the doorway 11 with the support members 13, 14, and 15 in place. Two extendable sleeve members 33 of tubing are slidably received on the tubing member 32. A small slot 34 is provided in the side wall of each tubular sleeve member 33 near the outer open ends. As best seen in FIGS. 3 and 9, a small hole 35 having a diameter at least as large as the width of slot 34 is provided through the side wall of the rectangular support sections 13, 14, and 15 in axial alignment with the center of each octagonal recess 18.

The outer diameter of each tubular sleeve member 33 is sufficient to fit within the opposing flats of octagonal recesses 18 (FIG. 9). The tubular sleeve members 33 are extended outwardly beyond the ends of the center tubing 32 to be received in horizontally opposed octagonal recesses 18 and are rotated to align the holes 34 and 35. When the sleeves 33 are in the correct extended position, an L-shaped rod or lock pin 36 is inserted through the hole 35 and slot 34. A small projection 37 depends from the end of the short leg 38 of the lock pin 36 parallel with the longer leg 39. The lock pin 36 is turned to position the projection 37 horizontally and the short leg 38 is inserted through the hole 35 and slot 34. The lock pin is then rotated 90° and the projection 37 is captured inside the slot 34 at the end of the sleeve member 33. In this manner, the chinning bar 31 is secured within rectangular recesses 18 and the sleeve members are prevented from horizontal or rotational movement.

For added convenience in facilitating the height adjustment and remembering a previous setting for the cross bar and/or chinning bar, a series of labels 40 are provided which bear numerals corresponding to the number of octagonal recesses. The labels may be applied to the outer surface of the support members perpendicular to the surface containing the recesses. The user may have one height setting which the uses for one type of exercise and another height for another exercise. With the recesses numbered, it will be very easy for the user to remember which setting he used previously for the appropriate exercise.

OPERATION

When not in use, the exercise apparatus may be stored in the secured position on the door jamb with the rectangular cross bar in the uppermost opposed octagonal recesses and the chinning bar installed in the recesses just below the cross bar. In this manner, the cross bar and chinning bar are above the height of the average person and the doorway is not obstructed.

A booklet instructing the user in specific exercises is provided with the apparatus. However, some typical exercises are illustrated herein to show the versatility of the invention. The novel rectangular cross bar provides the user with an improved gripping and support surface to provide a wide range of isometric, calisthenic, and isotonic exercises.

Figure 12:
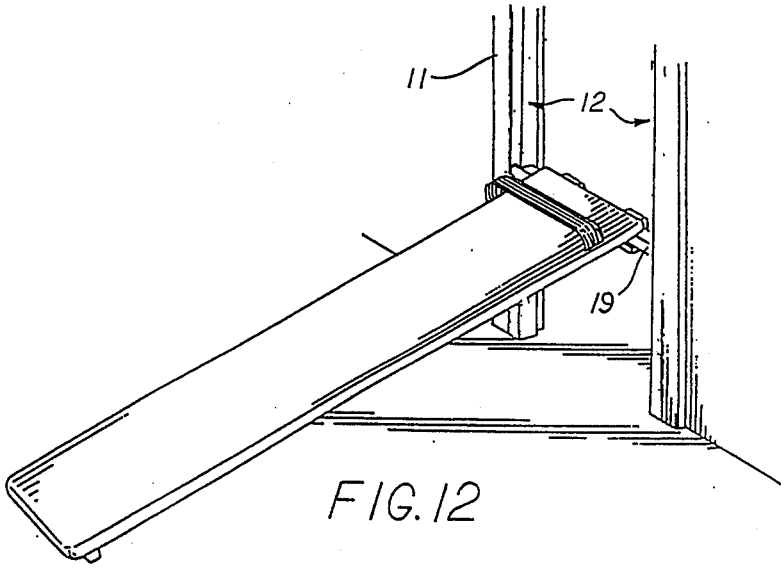
FIG. 12 is an isometric view of the exercise apparatus supporting an inclined board.
Figure 13:
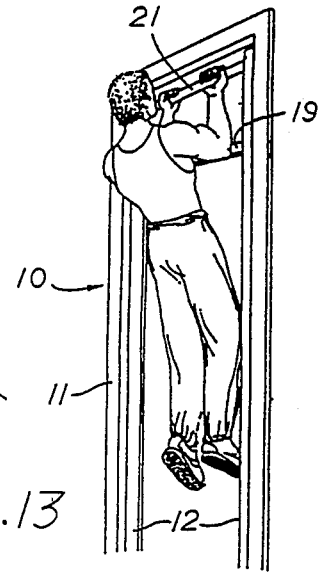
FIGS. 13, 14, 15, and 16 are illustrations of some various types of exercises which may be performed utilizing the exercise apparatus in accordance with the present invention.
Figure 14:
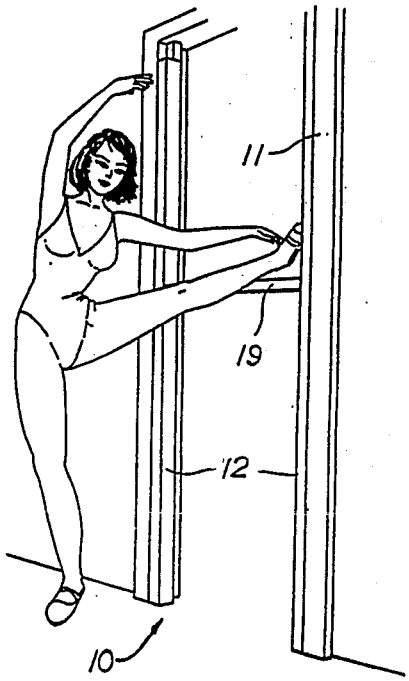
Figure 15:
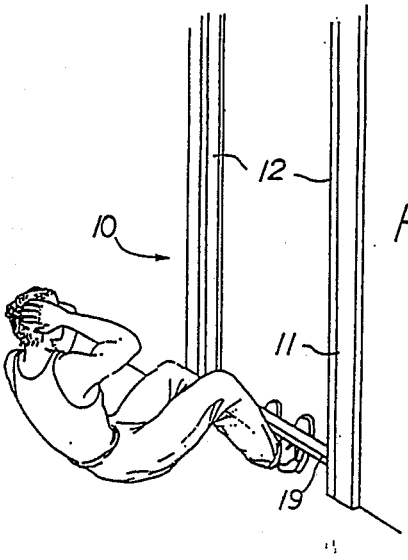
Figure 16:
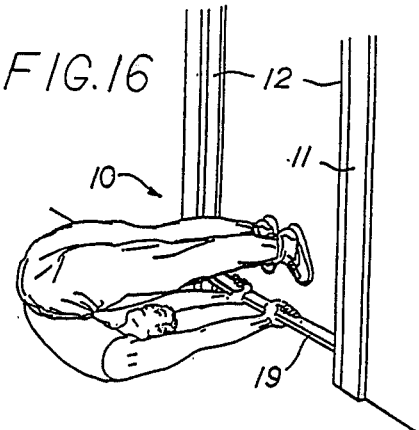

FIG. 12 shows the apparatus used to support an inclined board for working the abdominal muscles. FIGS. 13, 14, 15, and 16 illustrate various ways the apparatus may be used with the cross bar at different heights or used in conjunction with the chinning bar.

The cross bar when used with the chinning bar provides the user with a two bar leverage system for supporting the body in positions not available in a one bar system. When placed near the floor, the cross bar it can be gripped by the feet or hands. When placed near mid height, the cross bar allows the user to perform exercises by pushing or pulling up on the bar, or suspending the body in various positions from the bar. Stretching exercises may also be performed with the bar at mid height. The octagonal recesses 18 and cooperating end members 23 with the beveled edges 23*a* allow the bar 19 to be rotated 45° at a time. While the recesses 18 and end members 23 are shown to be octagonal, other regular polygonal shapes, e.g. hexagonal, could be used.

While this invention has been described fully and completely with special emphasis upon several preferred embodiments, it should be understood that within the scope of the appended claims the invention may be practiced otherwise than as specifically described herein.

I claim:

1. An exercise apparatus for installation in a conventional doorway and configured to allow for adjustable orientations comprising;

a pair of elongated support members, adapted to be secured in parallel relation on opposite sides of a door jamb, each member comprising separable sections and means for securing said sections together, a plurality of vertically spaced regular polygonal recesses of at least six sides on one side of each said support member so that pairs of said recesses are horizontally aligned when assembled in place to receive one end of an extendable horizontal cross bar configured to be adjustable within the polygonal recesses, said polygonal recesses of size and shape to receive to receive opposite tubular ends of an extendable chinning bar, a horizontal cross bar having an intermediate portion of rectangular cross section having a length less than the distance between the support members when installed, retractable means in said rectangular portion with end portions extendable therefrom configured to be adjustably fit within said polygonal recesses to prevent rotation of the cross bar during use and allow for the angular position of the cross bar to be adjustable about its longitudinal axis, means for maintaining said cross bar end portions in said extended position within said polygonal recesses of said cross bar during use, an extendable and retractable chinning bar having ends adapted, in the extended position, to be received within said polygonal recesses, locking means for maintaining said chinning bar end portions in said extended position within said polygonal recesses to prevent rotation of said end portions during use, and means for securing said support members in a fixed position against said door jamb.

2. An exercise apparatus according to claim 1 in which said polygonal recesses are octagonal in shape, and the ends of said cross bar are shaped to fit said octagonal recesses to prevent rotation of said cross bar during use, said octagonal recesses permitting installation of said cross bar in selected positions rotated 45° from each other.

3. An exercise apparatus according to claim 2 in which said sections of said support members have a rectangular recess in opposed ends, and are joined together by a rectangular plug connector having opposed ends received within the recesses of adjoining ends of said sections.

4. An exercise apparatus according to claim 2 in which said cross bar rectangular portion comprises rectangular tubing, said retractable means comprises a rectangular retractable member slidably positioned within each end of said rectangular tubing and extendable therefrom to position its outer end portion within said octagonal recesses, said outer end portion being of rectangular cross section to be received between opposing flats of said octagonal recesses, and means on said cross bar for maintaining said retractable member outer end portion in the extended position.

5. An exercise apparatus according to claim 4 in which said retractable member has a plurality of longitudinally spaced parallel holes extending transversely therethrough near the outer end portion, at least one of which is exposed in the extended position, and a lock pin removably received through the exposed hole nearest the end of the rectangular tubular member to prevent retraction of said retractable members within said rectangular tubular member when positioned in said octagonal recesses.

6. An exercise apparatus according to claim 4 in which said rectangular tubing has a slot near each end above said retractable member, and said means for maintaining said retractable member in the extended position comprises a knob having a threaded shaft passing through said slot and threadedly engaged in said retractable member and a shoulder portion engageable with the surface of said rectangular tubing surrounding said slot.

7. An exercise apparatus according to claim 6 including a plurality of longitudinally spaced parallel holes extending transversely through said retractable member near the outer end portion, at least one of which is exposed in the extended position, and a lock pin removably received through the exposed hole nearest the end of the rectangular tubular member to prevent retraction of said retractable members within said rectangular tubular member when positioned in said octagonal recesses.

8. An exercise apparatus according to claim 2 in which said extendable chinning bar comprises a center section of round tubing having a length less than the width of the doorway with said support members in place, and a pair of extendable tubular sleeve members, each slidably positioned on said center section and extendable laterally outward beyond the ends of said central section to fit the outer ends thereof within the opposing said octagonal recesses.

9. An exercise apparatus according to claim 8 in which said tubular sleeve members have an aperture near their outer ends, and support members have an aperture through the side wall of said support members in axial alignment with the center of each octagonal recess, and said locking means for maintaining said chinning bar end portions in said octagonal recesses comprises a lock pin releasably received in the apertures of said tubular sleeve members and said support members when axially aligned to prevent movement of said tubular sleeve members relative to said octagonal recesses.

10. An exercise apparatus according to claim 9 in which said lock pin comprises an L-shaped rod member having a small projection depending from the end of the short leg of the lock pin parallel with the longer leg which is received through said aligned apertures when said lock pin is turned horizontally and is captured within the tubular sleeve end portion when turned vertically to secure said tubular sleeve members in said octagonal recesses.

11. An exercise apparatus according to claim 2 in which said means for securing said support members in a fixed position against said door jamb comprises wood screws, and certain of said octagonal recesses have a hole through the bottom wall thereof to receive said wood screws.

12. An exercise apparatus according to claim 2 in which the surface of said support members facing outwardly of the doorway in the installed position have numerals each corresponding to the adjacent octagonal recess of said support members to identify height settings for various exercises.

13. An exercise apparatus according to claim 12 in which said numerals are imprinted on labels applied to the outwardly facing surfaces of said support members.

14. An exercise apparatus according to claim 2 including a series of labels to be applied to the outer surfaces of said support members perpendicular to the surface containing said octagonal recesses, said labels imprinted with numerals corresponding to the number of octagonal recesses and applied to the surfaces of said support members facing outwardly of the doorway in the installed position and adjacent the corresponding recess to identify height settings for various exercises.

15. An exercise apparatus according to claim 2 assembled on the jamb of a door frame for use.

* * * * *